US006537064B1

(12) United States Patent
Anderson

(10) Patent No.: US 6,537,064 B1
(45) Date of Patent: Mar. 25, 2003

(54) FLOW DIRECTOR FOR LINE BURNER

(75) Inventor: Kim A. Anderson, Green Bay, WI (US)

(73) Assignee: Megtec Systems, Inc., DePere, WI (US)

( * ) Notice: Subject to any disclaimer, the term of this patent is extended or adjusted under 35 U.S.C. 154(b) by 0 days.

(21) Appl. No.: 09/564,603

(22) Filed: May 4, 2000

(51) Int. Cl.[7] ..... F23D 14/62

(52) U.S. Cl. ..... 431/354; 431/350; 431/182; 431/8; 239/432

(58) Field of Search ..... 431/354, 351, 431/350, 185, 159, 181, 182, 175, 8, 9; 239/399, 403, 419, 566, 557, 432; 60/749

(56) References Cited

U.S. PATENT DOCUMENTS

| | | | | |
|---|---|---|---|---|
| 25,626 A | | 10/1859 | Buckwalter | |
| 1,771,875 A | | 7/1930 | Cowardin et al. | |
| 1,960,609 A | | 5/1934 | Werner | 158/104 |
| 1,990,962 A | | 2/1935 | Thorson | 158/110 |
| 2,276,131 A | | 3/1942 | Wiant | 299/59 |
| 2,824,603 A | | 2/1958 | Reed | 158/106 |
| 3,174,527 A | | 3/1965 | Reed et al. | 158/11 |
| 3,178,161 A | | 4/1965 | Yeo et al. | 263/19 |
| 3,237,677 A | | 3/1966 | Wiesenthal et al. | 158/11 |
| 3,297,259 A | | 1/1967 | Maxon, Jr. et al. | 239/397.5 |
| 3,511,589 A | | 5/1970 | Rothhaar et al. | 431/350 |
| 4,155,700 A | | 5/1979 | Babington | 431/117 |
| 4,340,180 A | | 7/1982 | Belknap et al. | 239/422 |
| 4,379,689 A | | 4/1983 | Morck, Jr. | 431/284 |
| 4,403,947 A | * | 9/1983 | Spielman | 431/354 |
| 4,483,832 A | | 11/1984 | Schirmer | 423/210 |
| 4,598,553 A | | 7/1986 | Saito et al. | 60/733 |
| 4,963,089 A | | 10/1990 | Spielman | 431/351 |
| 5,057,008 A | | 10/1991 | Dielissen | 431/351 |
| 5,131,836 A | | 7/1992 | Coppin | 431/12 |
| 5,236,350 A | | 8/1993 | Cummings, III et al. | 431/173 |
| 5,611,684 A | * | 3/1997 | Spielman | 431/354 |
| 5,662,467 A | | 9/1997 | Jones | 431/175 |
| 6,036,480 A | * | 3/2000 | Hughes et al. | 431/354 |

FOREIGN PATENT DOCUMENTS

| | | | |
|---|---|---|---|
| FR | 1 591 994 | * | 6/1970 |

* cited by examiner

*Primary Examiner*—Henry Bennett
*Assistant Examiner*—Josiah Cocks
(74) *Attorney, Agent, or Firm*—Mitchell D. Bittman; Kevin S. Lemack

(57) ABSTRACT

A burner having improved flame quality even at high turn-down ratios. The burner includes a flow director which is preferably a bent sheet or plate positioned in the burner to alter the flow geometry of the air component into a series of channels where the air mixes with the fuel. Preferably the flow director is perforated, the perforations providing a second avenue for the flow of air into the mixing channel.

8 Claims, 6 Drawing Sheets

FLOW DIRECTOR FOR LINE BURNER

BACKGROUND OF THE INVENTION

The present invention relates to burners, in particular, line burners for use in web supporting and drying apparatus, although other applications are within the scope of the invention.

According to conventional combustion science, each type of burner flame (e.g., premix flame, diffusion flame, swirl flame, etc.) burns with a different optimal stoichiometric mix of fuel to combustion air, by which low emission concentrations in the burner flue gas appear. It is therefore important to control or maintain the desired optimal stoichiometry of the burner. Failure to closely regulate the burner air/fuel ratio over the range of burner output can lead to poor flame quality and stability (flameout, yellow flames, etc.) or excessive pollution (high $NO_X$, CO).

The turn-down ratio of a burner is the ratio of a maximum firing rate to a minimum firing rate for a particular burner, where firing rate is the measure of the amount of fuel gas consumed per hour, such as BTU/hour. A high turn-down ratio is preferred, since this indicates that the burner is consuming less fuel at the minimum firing rate.

U.S. Pat. No. 5,662,467, the disclosure of which is hereby incorporated by reference, discloses a nozzle mixing line burner having a combustion chamber and a nozzle body having two channels, each of which receives air and fuel. The mixture of air and fuel from each channel is discharged into the combustion chamber where they are mixed. However, at most turned-down firing conditions (i.e., low firing rates), mixture is inadequate and flame quality is diminished.

It would therefore be desirable to improve the flame quality of line burners especially at low firing rates.

SUMMARY OF THE INVENTION

The problems of the prior art have been overcome by the present invention, which provides a burner having improved flame quality even at high turn-down ratios or low firing rates. The burner includes a flow director which is preferably a bent sheet or plate positioned in the burner to alter the flow geometry of the air component into a series of channels where the air mixes with the fuel. Preferably the flow director is perforated, the perforations providing a second avenue for the flow of air into the mixing channel.

DETAILED DESCRIPTION OF THE INVENTION

Figure 2:
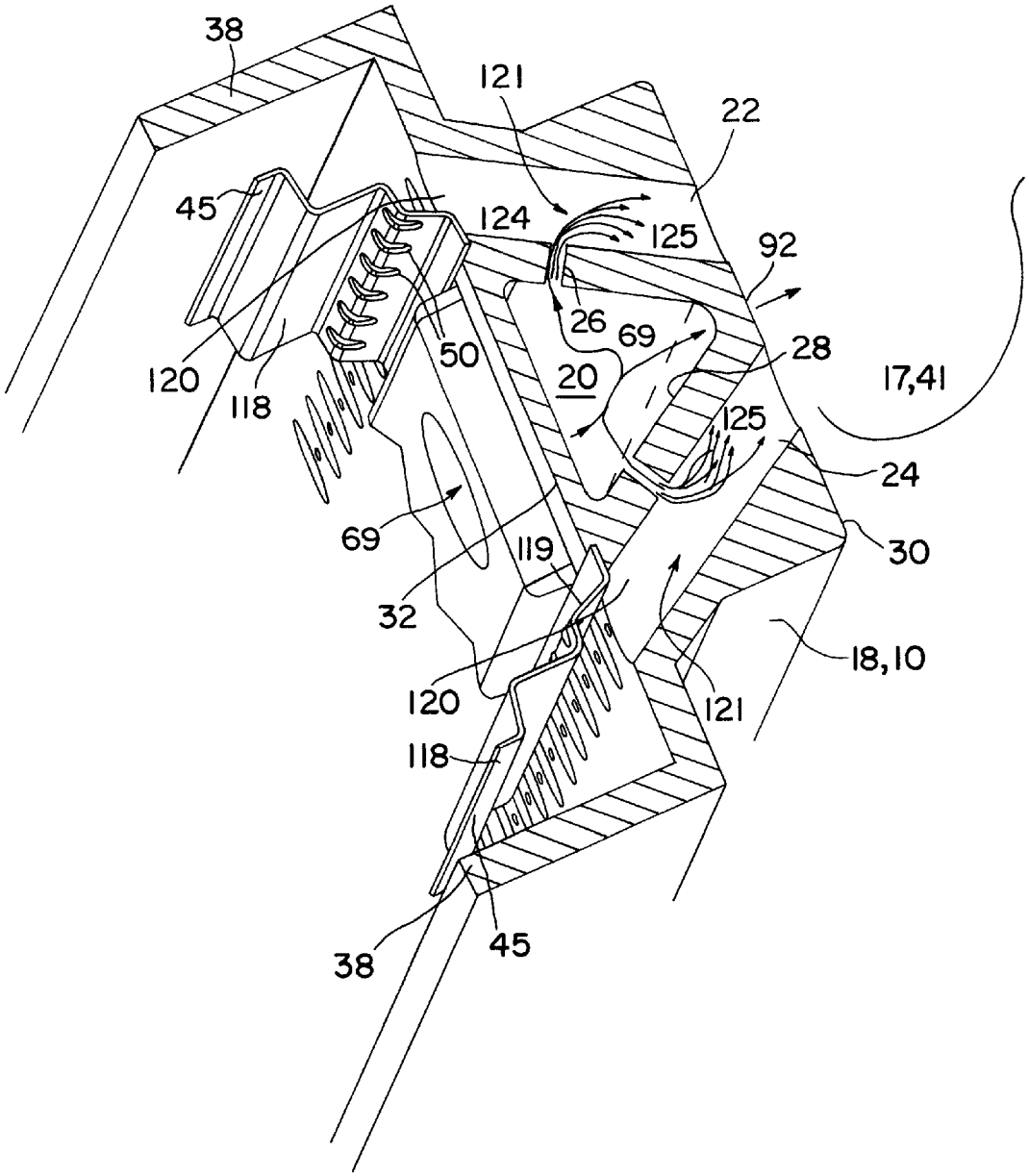
FIG. 2 is cross-sectional view of a line burner in accordance with the present invention.

Turning first to FIG. 2, a nozzle body 18 is shown having a fuel distribution chamber 20, two rows of opposing fuel/air mixing channels 22, 24, and one or more fuel passages 26, 28 providing communication between fuel-distribution chamber 20 and each mixing channel 22, 24. The nozzle body is preferably constructed of iron and is unitary, although other materials such as aluminum or sheet metal can be used. Fuel is dispersed from the fuel distribution chamber 20, which has a triangular cross-section, into each mixing channel 22, 24 by the respective fuel passages 26, 28, as shown by the arrows 69 in FIG. 2. The channels 22, 24 are angled and converge towards a combustion chamber defined by opposite side walls 63 (FIG. 5, only one side wall shown) attached to the nozzle body 18 so that the flame 17 fires into the combustion chamber. This burner design is that disclosed in U.S. Pat. No. 5,662,467 and familiarity therewith is assumed.

Figure 5:
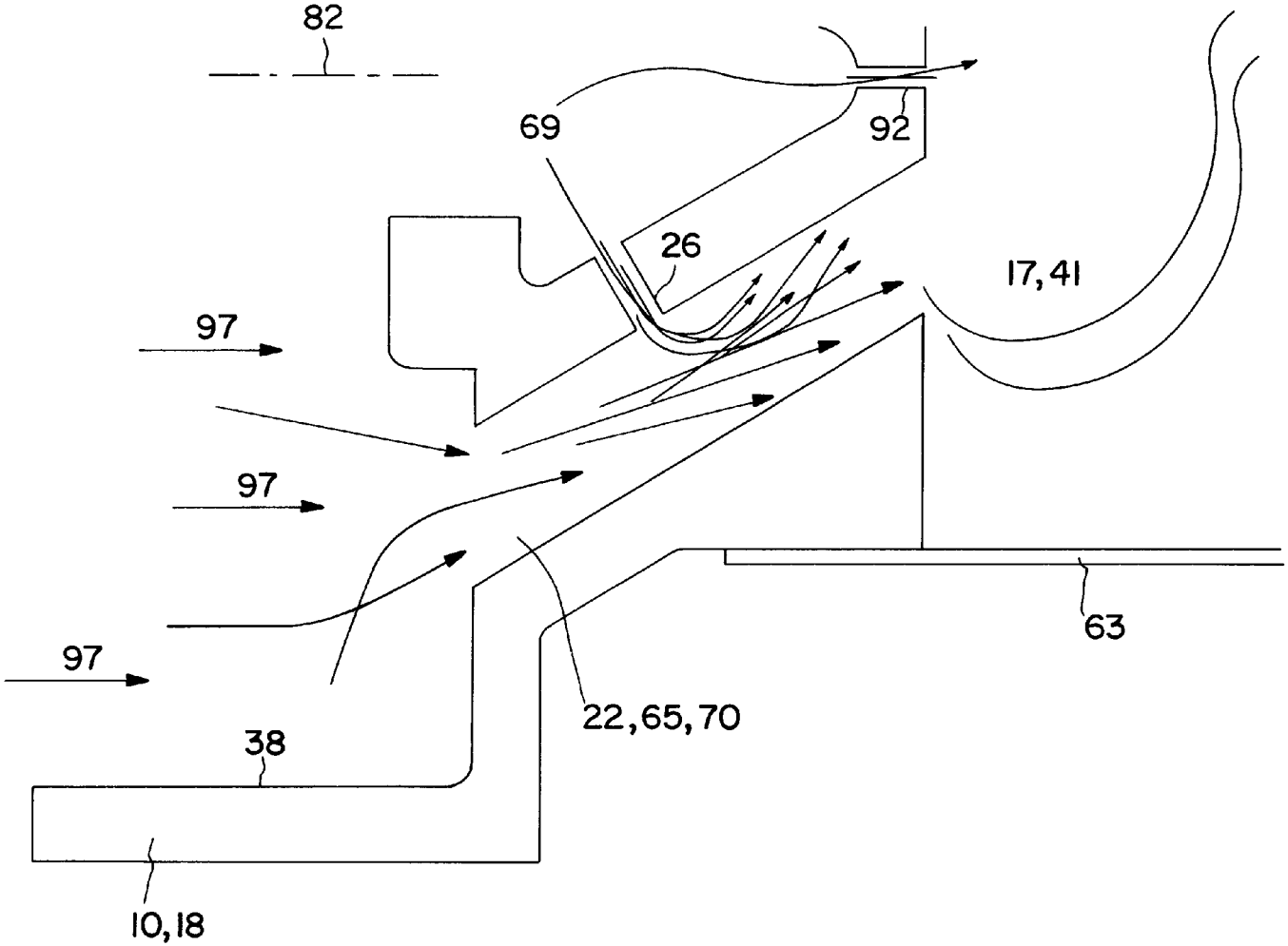
FIG. 5 is a schematic view showing air flow in a burner in accordance with the prior art.

As illustrated in FIG. 5, nozzle body 18 of burner 10 includes two rows of opposing angled fuel/air mixing channels 22 (only one shown) which extend between spaced front and back faces 30, 32 of the nozzle body 18. Air enters channels 22, 24 in a predominantly parallel direction relative to the outer walls of each channel 22, 24 as shown by arrows 97. In contrast, fuel passage 26 communicating with each channel 22, 24 is located along the innermost side of each angled channel 22, 24. As a result, there is an impingement zone 17 where the air and fuel mix to provide flame stability. However, evaluation of the burner in operation indicates that the flame 41 has regions where the flame is not well established. The voids within the flame 41 are most obvious at locations where the fan could most easily force the air through the nozzle body 18, suggesting a location where the mix of air and fuel is not optimal, or the air flow through body 18 is not uniform.

Figure 1:
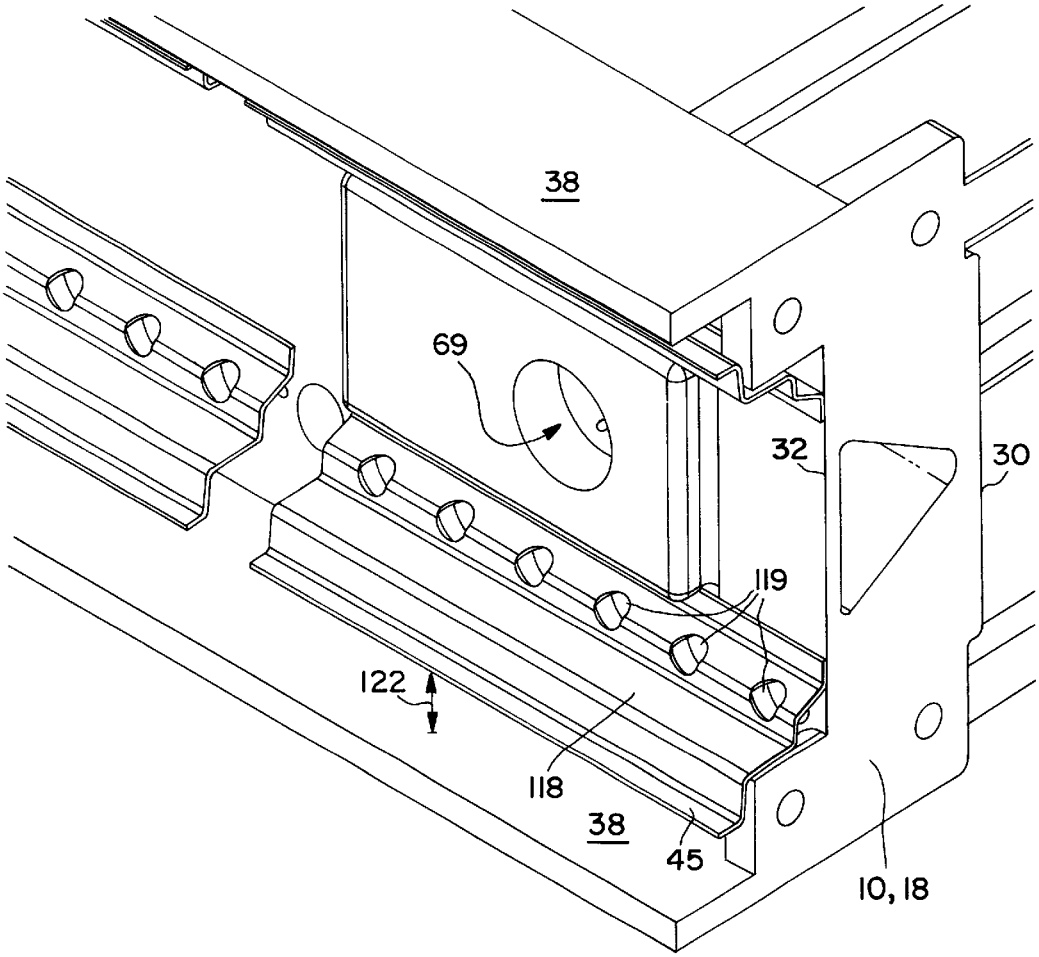
FIG. 1 is a perspective view of a line burner in accordance with the present invention.

In order to ensure adequate mixing of the air and fuel components and uniform air flow, FIGS. 1 and 2 show the placement of a flow director 118 in the nozzle body 18 upstream of the inlets to the channels 22, 24 in order to direct the flow of air into one or preferably both of the rows of mixing channels 22, 24 in accordance with the present invention. The flow director 118 forces the air 121 to distribute along an air gap 122 (FIG. 1) created between each leg 38 of the nozzle body 18 (which leg 38 can be unitary with the nozzle body or coupled thereto by any suitable means known to those skilled in the art, such as welding or riveting, and which also can serve as a mounting wall for an air housing) and the free flange end 45 of each flow director 118. This gap 122 extends in the longitudinally direction along the entire length of the flow director 118. In addition, a plurality of apertures 119 are formed in the flow director 118, which apertures 119 also allow source air 120 to enter each channel 22, 24. Preferably the apertures are circular and evenly spaced as shown, although other shapes can be used. The apertures 119 should align with corresponding apertures in the nozzle body 18 providing entry into the channels 22, 24. The air gap 122 is preferably at least as wide as the diameter of the apertures 119. It is most preferably ⅜ of an inch wide.

Figure 3:
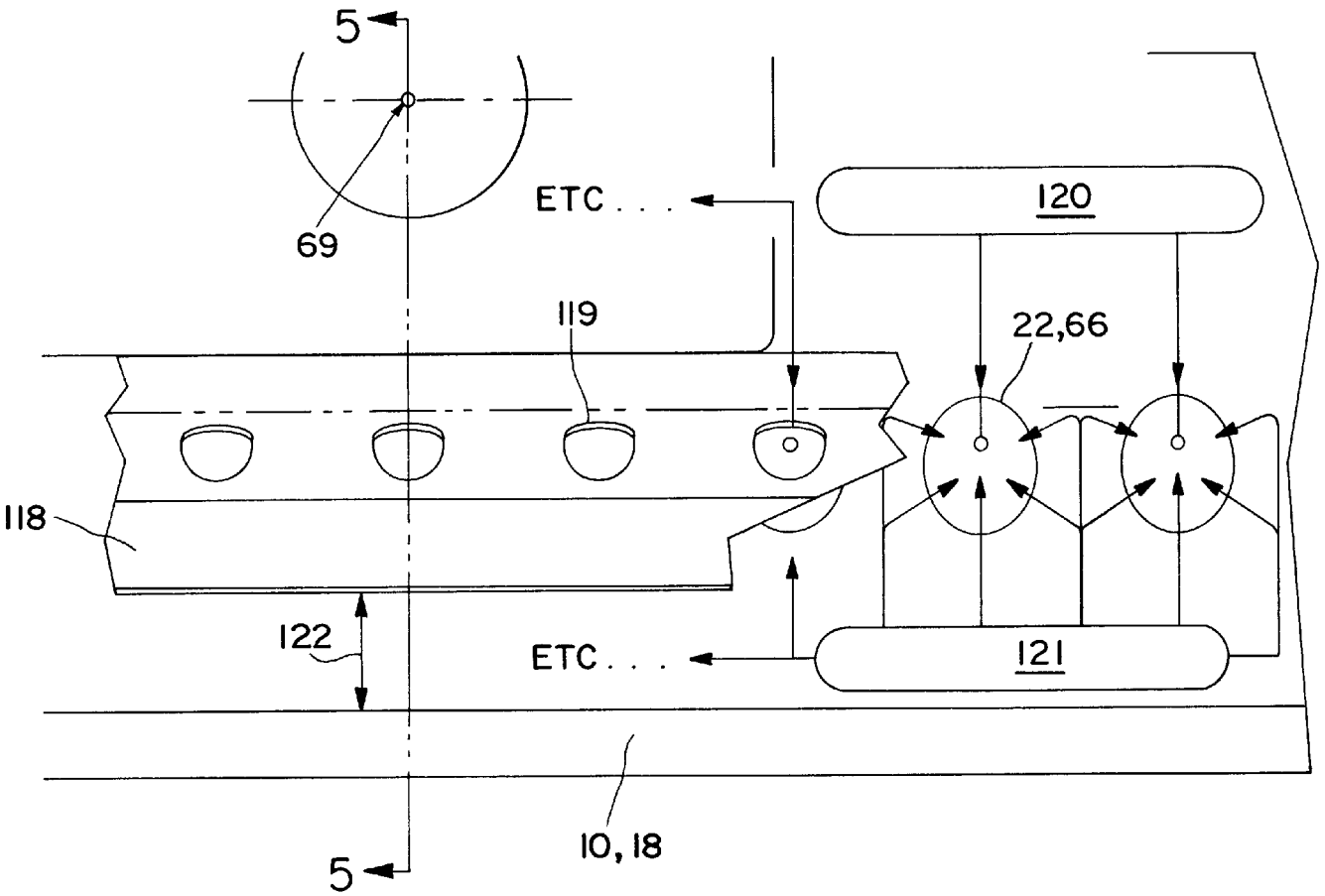
FIG. 3 is a section view of the flow director for the burner in accordance with the present invention.
Figure 4:
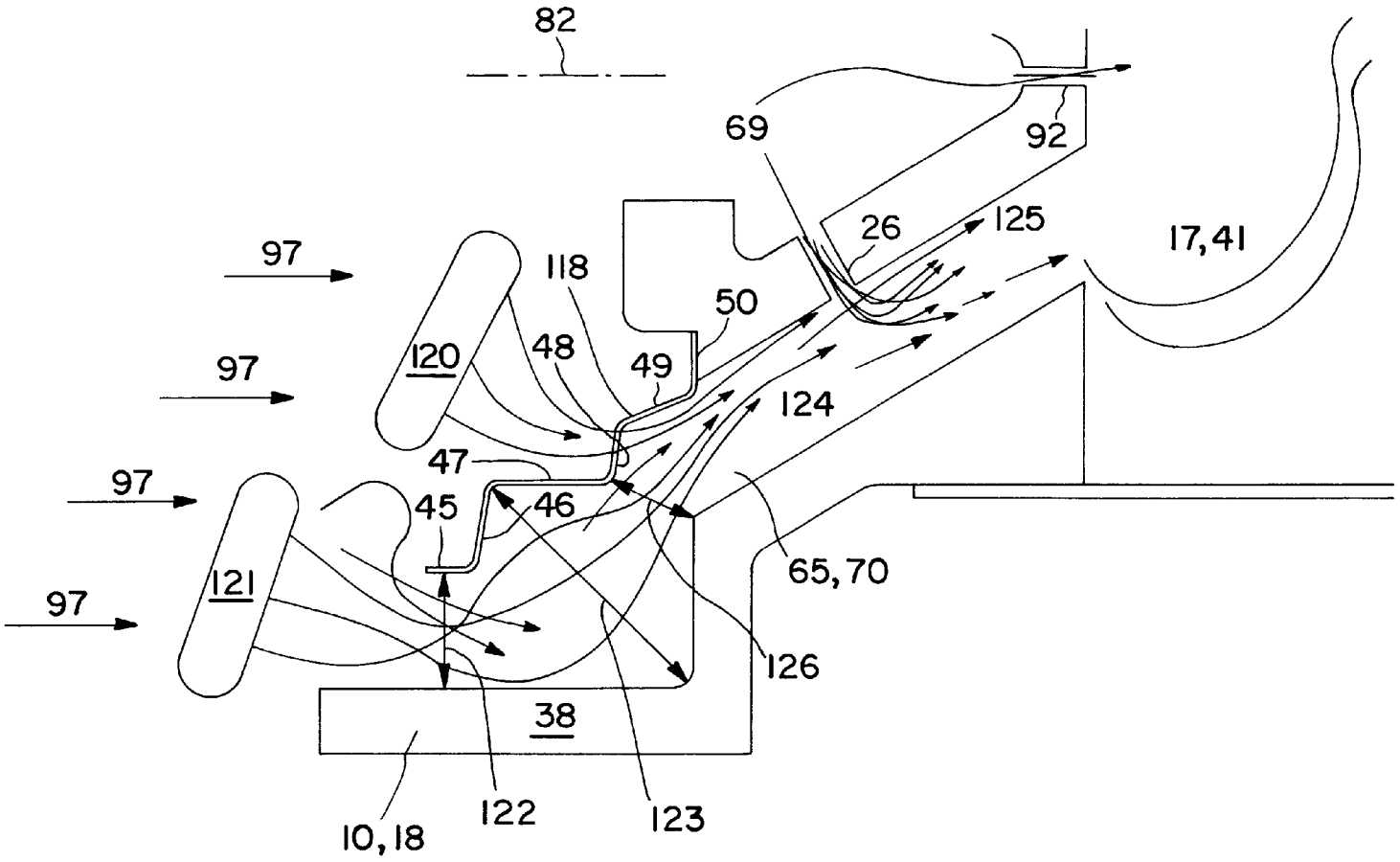
FIG. 4 is a schematic view showing air flow in a burner in accordance with the present invention.

As illustrated in FIG. 4, primary air 121 is sheltered by the redistribution zone 123 defined by the flow director 118 and the nozzle body 18. Secondary air 120 is a smaller air component relative to primary air 121, and is traveling in a well-defined direction when discharged through apertures 119. The primary air 121 is quieted by redistribution zone 123, and flows to fill in around the discharge of secondary air 120 as shown in FIG. 3. The secondary air 120, which has a velocity, assists the primary air 121 in flowing into the channels 22, 24 and combines with the primary air 121.

Comparing the area of the secondary holes 119 to the combined slot and hole area, it is found that this ratio is 0.23. Thus, it is expected that about ¼ of the flow into the channel 22 is from the secondary holes 119. If a separate, high pressure air source were used to supply the secondary air to holes 119, then a much smaller amount of area, about 5%, could be used since the higher pressure would give the secondary air a much higher velocity. The amount should be less than 50%, however. If the holes provide too much flow, the flow may stratify on the opposite wall.

The flow director 118 causes the air 97 to assume a general directionality more like the path of the fuel/air mixing channels 22, 24. Flow director 118 promotes the resulting focused air 124 to mix with the fuel 69 at the end of fuel passages 26, 28 before the mixture leaves the air/gas mixture zone 125 in each of the channels 22, 24. Although the present invention should not be so limited, it is believed that the improved mixing is due to the following phenomenon. Since the fuel 69 voids from fuel passages 26, 28 with some velocity, the best mixing potential is found where the fuel is just leaving passages 26, 28 due to cross-velocity with the impinging air. By focusing the air 124 to generally flow along the innermost side of the channels 22, 24, the air is available to mix with the fuel in the most ideal location for intimate and complete mixing. The arrows in FIG. 4 illustrate the respective flows of the air 125 and fuel 69, in contrast to the prior art flow of FIG. 5 where the air 97 is predominantly aligned toward the outermost side of the channels 22, 24. Since the volume of air 97 is larger than the volume of fuel 69, the air tends to force the fuel volume toward the innermost side, leaving a two component, mostly stratified and laminar flow where the fuel has little opportunity to mix early on with the air in the prior art device.

Figure 7:
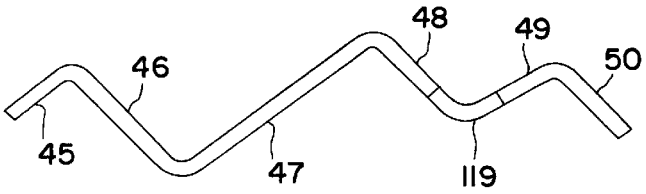
FIG. 7 is a cross-sectional view of a flow director in accordance with a preferred embodiment of the present invention.

Flow director 118 is preferably constructed of 20 ga steel, formed into a generally inclined cross-section with a multiple of bends or steps. The preferred configuration is illustrated in the drawings, particularly FIG. 7, and includes a first free flange end 45 which is substantially parallel to nozzle leg 38; a first bent section 46 extending substantially orthogonally from the flange end 45; a second bent section 47 extending substantially orthogonally from first bent section 46 and being substantially parallel to nozzle leg 38, the second bent section being longer than the first free flange end 45; a third bent section 48 extending substantially orthogonally from the second bent section 47, the third bent section 48 having formed therein a plurality of spaced apertures 119 in the direction along the longitudinal direction of the nozzle 18, the third bent section 48 being shorter than the first bent section 46; a fourth bent section 49 extending from the third bent section in a direction substantially parallel to the channel 22; and a fifth bent section 50 extending from the fourth bent section 49 in a direction substantially orthogonal to the nozzle leg 38. The fifth bent section 50 is attached to nozzle body 18 between the fuel distribution chamber 20 and channel 22 by any suitable means, such as welding, screwing, riveting or trapping with an end cap. Preferably the flow director 118 extends longitudinally along each side of nozzle body 18 to serve a majority of the channels 22, 24 with a distributed air flow 124. Most preferably, the flow director 118 extends longitudinally along each side of nozzle body 18 to serve all of the channels 22, 24, with the provision for a gap in flow director 118 to provide access for the burner ignition and flame supervision devices to pass through. In the preferred embodiment, the flow director 118 is 2.125 inches long and 13/32 inches high, and the apertures 119 are ⅜ inch diameter holes spaced on 1 inch centers.

The flow director 118 can be formed as an integral part of the nozzle body 18, or can be a separate sheet attached during or after construction of the nozzle body 18.

Figure 6:
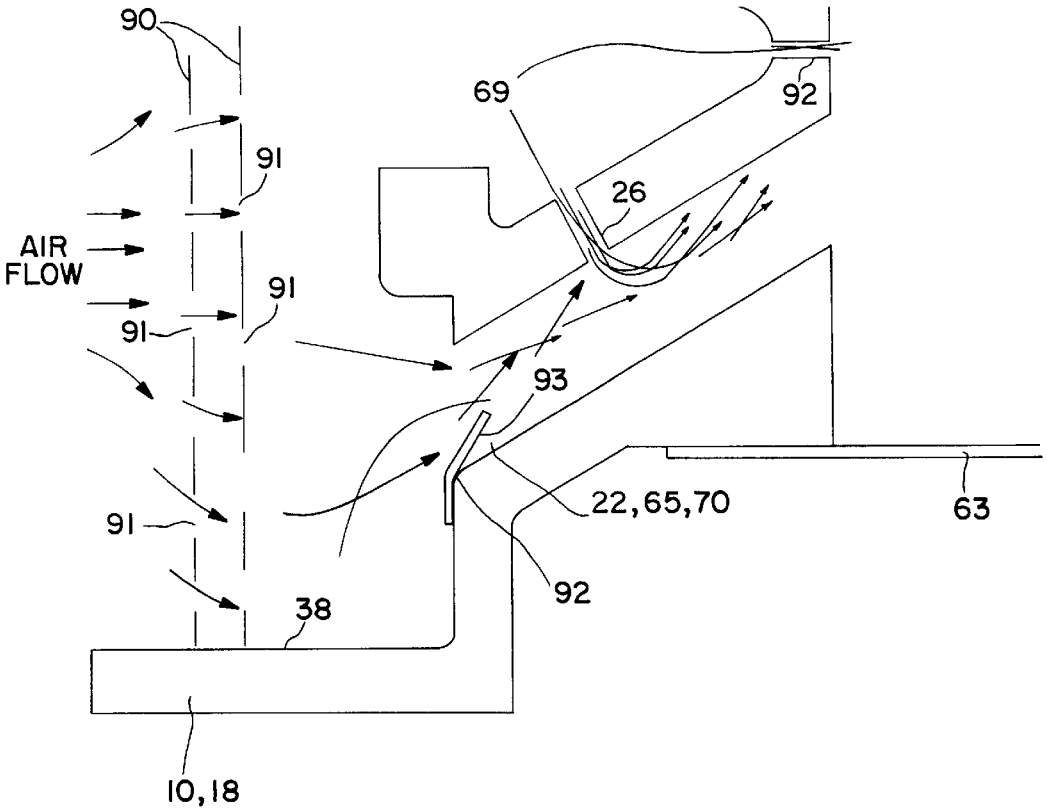
FIG. 6 is a schematic view showing air flow in a burner in accordance with an alternative embodiment of the present invention.

FIG. 6 illustrates an alternative embodiment of the flow distributor of the present invention. In this embodiment, redistribution of air and proper mixing is accomplished by one or more perforated plates 90, and the optional use of a deflector or swirl producing device 92. The perforated plate(s) 90 have a series of spaced apertures 91 positioned along their length. In the preferred design, the open area (per foot of burner length) of the plate 90 is between about 5–40%, more preferably 10–20%, most preferably about 15.2% for a single plate. If multiple plates are used, then an open area of about 40 to about 75% would be effective, preferably about 60% to about 65%.

The deflector 92 is a bent sheet positioned at the elbow 95 of the nozzle body 18 as shown. It functions to deflect the incoming air in the direction of the arrows and promotes uniform mixing in the passageway 22. The length of the free end 93 of the deflector 92 can be readily determined by those skilled in the art for optimal mixing.

Desirable turn-down ratios are 10–20, which allow stable minimum firing rates.

What is claimed is:

1. A burner comprising a nozzle body having a front face and a back face spaced from said front face, said back face being in communication with an air supply and with a fuel supply, said nozzle body comprising:

a channel between said front face and said back face, said channel having an air inlet for receiving air from said air supply and having a fuel inlet receiving fuel from said fuel supply, and at least one flow director positioned upstream of said air inlet, said flow director directing the flow of air into said air inlet to mix said air supply with said fuel in said channel; said flow director having a free end, a first bent portion extending from said free end, a second bent portion extending from said first bent portion, a third bent portion extending from said second bent portion, a fourth bent portion extending from said third bent portion, and a fifth bent portion extending from said fourth bent portion and being coupled to said nozzle body.

2. The burner of claim 1, wherein said nozzle body further comprises opposite sides extending from said back face, and wherein said at least one flow director defines with one of said opposite sides a redistribution zone for flow of said air supply prior to said air supply entering said inlet.

3. The burner of claim 1, wherein said flow director comprises a plurality of apertures.

4. The burner of claim 1, wherein said third bent portion comprises a plurality of apertures.

5. The burner of claim 1, wherein each of said bent portions is bent at an angle of about 90°.

6. A burner comprising a nozzle body having a front face and a back face spaced from said front face, said back face being in communication with an air supply-and a fuel supply, said nozzle body comprising:

two rows of a plurality of channels between said front face and said back face, each said channel having an air inlet for receiving air from said air supply and having a fuel inlet for receiving fuel from said fuel supply, and a flow director positioned upstream of each said air inlet, each flow director directing the flow of air into each said air inlet to cause said air to mix with said fuel in each of said channels; said flow director having a free end, a first bent portion extending from said free end, a second bent portion extending from said first bent portion, a third bent portion extending from said second bent portion, a fourth bent portion extending from said third bent portion, and a fifth bent portion extending from said fourth bent portion and being coupled to said nozzle body.

7. The burner of claim 6, wherein said third bent portion comprises a plurality of apertures.

8. The burner of claim 6, wherein each of said bent portions is bent at an angle of about 90°.

* * * * *